US006886645B2

(12) United States Patent
Bise et al.

(10) Patent No.: US 6,886,645 B2
(45) Date of Patent: May 3, 2005

(54) LIQUID SEAL FOR WET ROOF BIT

(75) Inventors: Douglas E. Bise, Chilhowie, VA (US); Phillip W. Haga, Chilhowie, VA (US)

(73) Assignee: Kennametal Inc., Latrobe, PA (US)

( * ) Notice: Subject to any disclaimer, the term of this patent is extended or adjusted under 35 U.S.C. 154(b) by 5 days.

(21) Appl. No.: 10/159,875

(22) Filed: May 30, 2002

(65) Prior Publication Data

US 2003/0051920 A1 Mar. 20, 2003

Related U.S. Application Data

(60) Provisional application No. 60/322,645, filed on Sep. 17, 2001.

(51) Int. Cl.[7] ..... E21B 10/38

(52) U.S. Cl. ..... 175/417; 175/320; 175/418; 175/420.1

(58) Field of Search ..... 175/417, 418, 175/420.7, 320

(56) References Cited

U.S. PATENT DOCUMENTS

| | | | | |
|---|---|---|---|---|
| 3,187,825 A | | 6/1965 | Bower, Jr. | 175/327 |
| 4,124,220 A | * | 11/1978 | Leone et al. | 277/502 |
| 4,175,757 A | | 11/1979 | Emmerich | |
| 4,226,290 A | | 10/1980 | McSweeney | 175/320 |
| 4,489,796 A | | 12/1984 | Sanchez et al. | 175/410 |
| 4,527,638 A | | 7/1985 | Sanchez et al. | 175/57 |
| 4,527,931 A | | 7/1985 | Sarin | 407/113 |
| 4,550,791 A | | 11/1985 | Isakov | 175/410 |
| 4,603,751 A | | 8/1986 | Erickson | 175/410 |
| 4,615,402 A | | 10/1986 | Eisenloeffel | |
| 4,696,352 A | | 9/1987 | Buljan et al. | 175/57 |
| 4,711,312 A | | 12/1987 | Leibee et al. | |
| 4,817,742 A | | 4/1989 | Whysong | 175/410 |
| 4,817,743 A | | 4/1989 | Greenfield et al. | 175/411 |
| 4,993,379 A | * | 2/1991 | Viazzi | 277/502 |
| 5,172,775 A | | 12/1992 | Sheirer et al. | 175/57 |
| 5,184,689 A | | 2/1993 | Sheirer et al. | 175/420.1 |
| 5,287,937 A | | 2/1994 | Sollami et al. | 175/427 |
| 5,297,643 A | | 3/1994 | Montgomery, Jr. et al. | 175/393 |
| 5,325,931 A | | 7/1994 | Woods | 175/257 |
| 5,400,861 A | | 3/1995 | Sheirer | 175/427 |
| 5,429,199 A | | 7/1995 | Sheirer et al. | 175/321 |
| 5,452,628 A | | 9/1995 | Montgomery, Jr. et al. | 76/108.2 |
| 5,467,837 A | | 11/1995 | Miller et al. | 175/420.1 |
| 5,704,438 A | | 1/1998 | Kloppers et al. | 175/420.1 |
| 5,833,017 A | | 11/1998 | Woods et al. | 175/320 |

(Continued)

OTHER PUBLICATIONS

Kennametal Inc., "Cutting and Drilling Systems" brochure, 5419 wet chuck 1012088, B00–023(10)J0, (2000), p. 52.

Invitation to Pay Additional Fees in counterpart PCT Application No. PCT/US02/28336, mailed Dec. 10, 2002, issued by the International Searching Authority and Communication Relating to the Results of the Partial International Search.

Intl. Search Report in international appln. No. PCT/US02/28336, filed Sep. 9, 2002, mailed Apr. 14, 2003.

*Primary Examiner*—David Bagnell
*Assistant Examiner*—Giovanna Collins
(74) *Attorney, Agent, or Firm*—Matthew W. Smith

(57) ABSTRACT

Fluid roof bits for mining typically supply high pressure water to a location immediately adjacent the cutting insert of the roof bit to flush debris and cool the cutting insert. The present invention is a drill steel assembly for a wet roof bit that reduces the fluid pressure loss supplied to the roof bit. A drill head body is connected to the drill steel by an intermediate adaptor. The adaptor has a spring loaded button thereon that mates with an opening in the drill head body so that the drill head body can be conveniently snapped onto the drill head assembly. A bushing seal made from a flexible material is clamped between said drill steel adaptor and the drill head body to limit fluid pressure losses.

4 Claims, 2 Drawing Sheets

U.S. PATENT DOCUMENTS

| | | | | |
|---|---|---|---|---|
| 5,927,411 | A | 7/1999 | Sheirer | 175/417 |
| 5,996,714 | A | 12/1999 | Massa et al. | 175/413 |
| 6,044,920 | A | 4/2000 | Massa et al. | 175/417 |
| 6,109,377 | A | 8/2000 | Massa et al. | 175/417 |
| 6,145,606 | A | 11/2000 | Haga | 175/420.1 |
| 6,176,332 | B1 | 1/2001 | Massa et al. | 175/420.1 |
| 6,260,638 | B1 | 7/2001 | Massa et al. | 175/427 |
| 6,315,064 | B1 | 11/2001 | Massa et al. | 175/420.1 |

* cited by examiner

LIQUID SEAL FOR WET ROOF BIT

This application is a continuation of U.S. Provisional Application No. 60/322,645, filed Sep. 17, 2001.

BACKGROUND OF THE INVENTION

1. Field of the Invention

This invention relates to a method and apparatus for drilling holes in mines for inserting roof bolts so that roof bolts can be inserted and fixed in roof rock faces to prevent their collapse.

2. Prior Art

Procedures utilized for the subterranean mining of coal have been greatly improved over the past several decades, both from the standpoint of operational safety on the part of miners as well as from the standpoint of their productivity. However, mining practices still are considered to be labor intensive, a factor significant in the pricing of coal. Additionally, current mining procedures necessarily continue to pose severe occupational safety difficulties. While current techniques of subterranean mining specific to a given strata being worked may represent a variety of technical approaches, the sequence of a given coal mining operation tends to follow a general pattern wherein machines of one variety or another work at the face of a seam to extract coal which then is conveyed outwardly from the mine. During this extraction procedure, there is created a progressively expanding subterranean cavern or chamber. As this procedure is carried out, the structural integrity of the immediately adjacent portions of the cavern roof or supporting portions is jeopardized. Consequently, the roof must be buttressed.

A variety of techniques have been developed and continue to be developed to achieve roof integrity; however, an important and most prevalent one of such techniques provides for the utilization of what are referred to in the art as "roof bolts". A roof bolt assembly 8 is shown generally in FIG. 1. Typically, the procedure for bolting involves first, the carrying out of vertical and predetermined angular drilling through the roof of a recently mined area. This drilling normally will extend at least through a predetermined width of strata. Next, elongate steel bolts are inserted into the bores 6 and anchored therein, terminating at face plate 2 adjacent the cavern roof.

In the past, rotary drilling and coring tools, as used in mining and construction, have been constructed with hardened drill bit cutting heads, and traditionally with sintered carbide inserts to prolong the operative life of the tool. Typical cutting tools may use a single or continuous cutting surface or edge, but most frequently employ a plurality of discrete cutting elements or coring bits either sequentially or angularly arranged on a rotary bit or auger of some type.

A principal problem encountered in all of these prior art tools has been the rapid wear and high cost of replacement along with machine downtime. Such rapid tool wear and breakage, in part due to higher speed equipment and heavier frictional forces and tensile stress, has led toward tool redesign with some larger carbide insert or drilling tip configurations—which in some applications has resulted in higher dust levels and increased potential ignition dangers contrary to mining safety regulations. Pressurized water supplied to roof bit drilling operations adjacent to the drill bit has been employed to reduce dust and improve drilling rates.

Wet carbide drilling in the past utilized the delivery of water or other flushing fluids at low pressures in the range of 60–80 psi. The result of such prior art methods was that a single rotary drill bit using a sintered carbide insert, such as a roof drill bit of the type shown in the drawings, should be expected to drill at least one four (4') foot bore before breaking or wearing out and might drill several of such bores, although in some hard rock formations, two or more prior art carbide bits might be required to drill a single 4' bore. As detailed in U.S. Pat. No. 5,303,787, wet drilling increased performance and reduced dust and produced dramatic results even using the traditional methods of the prior art. Some comparison tests pertaining to water pressure changes only have been made in the industry; nine (9) insert rotary roof bits were operating at a conventional water pressure of 80 psi drilled 12,420 feet of rock for an average of 1,380 ft./bit. In this comparison test, eighteen rotary roof bits embodying the same configuration were operated in the same mine at water pressures of 300 psi and drilled 72,822 feet of rock for an average of 4,056 ft./bit.

In many instances, certain of the interconnected components of the drill steel are lost by virtue of their frictional engagement within the bore, which they have formed. For the most part, the drill steel components are interconnected by slideably mating male and female connections, which have no provision for providing tensional coupling to permit forced withdrawal from a bore. Some attempts to alleviate this drill steel loss have generally looked to the use of pins, which are driven through mating bores, which are formed within the female and male connections. However, such arrangements are found to be impractical in actual mining practice. The miner, generally operating in a posture somewhat near to prone, will remain entirely unappreciative of requirements for carrying punch and hammer first to insert, then to remove the pins as the drill steel is withdrawn from the bore. Such removal within a mine atmosphere is both hazardous and entirely impractical from a human engineering standpoint. Snap buttons have been adopted to simplify assembly of the drill steel and enable a miner to assemble the drill steel together quickly in a convenient manner. Such snap on coupling devices, however, are subject to leaking, resulting in undesirable water pressure losses in wet drilling operations.

SUMMARY

The present invention is addressed to a roof drilling system for subterranean mining applications improving the efficiency, safety and economics of present-day mine securing techniques. Recognizing the realities of the physical requirements levied upon miners carrying out roof drilling operations, the system of the invention provides for an effective and convenient withdrawal of drill steel immediately following formation of a roof bore. However, once the drill head is lowered from the face of the bore and, consequently, the drill steel assemblage is lowered, a simple, push button release maneuver on the part of the miner provides for full disconnection of the drill steel from the drill head assembly.

It is an object of the present invention, therefore, to provide an improved rotary mining tool characterized by increased wear resistance and tool life; to provide novel methods of rock mining in which the tool life is greatly prolonged; to provide methods utilizing substantially increased water delivery rates to cool the roof bit and reduce dust, wherein a liquid seal is included in the drill head assembly so that water is communicated adjacent to the roof bit insert without substantial leaking or pressure loss.

DESCRIPTION OF THE INVENTION

Figure 1:
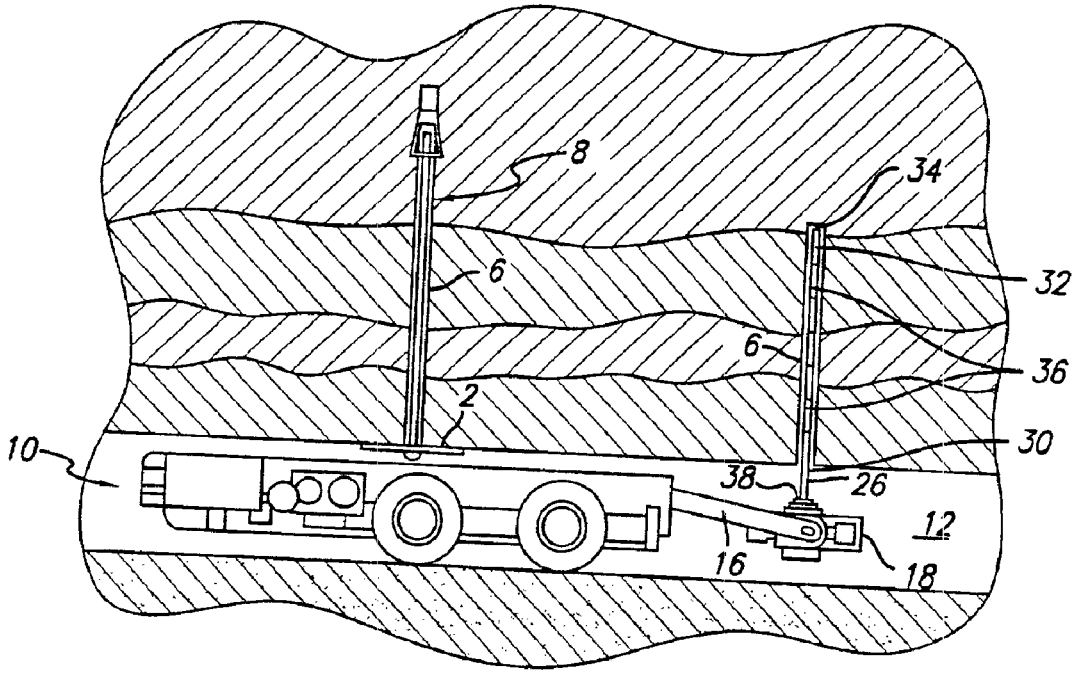
FIG. 1 is a sectional pictorial representation of a mining apparatus used for mining a seam having a roof bit drill for drilling bores.

Referring to FIG. 1, a typical roof-drilling machine is depicted generally at 10. Machine 10 is designed such that it operates in conjunction with the relatively low seams of coal now often encountered in mining operations. For example, the roof of the subterranean cavern 12 formed subsequent to the removal of coal from the seam, may be as low as about thirty inches, a height still of magnitude sufficient to carry out mining operations. In conventional mining practice, following the extraction of a given quantity of coal or other mined commodity from the seam, extraction and shuttle mechanisms are removed from the recently mined area and drilling machines as at 10 are advanced to aid in carrying out necessary roof bolting operations to secure the roof. Boom components 16 are operated by a miner and may be lowered such that drill head 18 touches the floor of the cavern. In the course of providing a vertical bore, the miner insets the drive-in portion of a starter steel component within the chuck and receiving cavity of drill head 18.

Starter steel components generally will incorporate a drill bit at their tip and the head 18 rotates the assemblage while being elevated by boom 16 in a manner defining a consistent vertical drill axis orientation. A driver steel component, as represented at 30 in FIG. 1, is inserted within the receiving cavity of the chuck of drill head 18. To this driver steel component 30 directly or indirectly is attached a "finisher" which serves as a holder for the drill bit for ensuing drilling operations. Such a finisher component is represented in FIG. 1 at 32, while the drill bit head, conventionally formed of carbide, is represented at 34.

For low seam coal, a succession of such drill elongating manipulations are required, a predetermined number of middle extension components, as represented at 36 in FIG. 1, being inserted between the driver steel component 30 and finisher component 32 to achieve requisite bore height. Of course, the lengths of any of the above components selected will depend upon a seam height encountered.

Upon completion of a bore, the drill steel assembly must be removed therefrom and the general practice in this regard is to lower boom 16 and head 18. As the head 18 is lowered, the drive-in portion 38 of the driver steel component 30 slides directly outwardly from the receiving cavity of the rotatable chuck. Grasping the exposed shank portion of the driver steel 30 and subsequent extensions 36 as well as finisher 34, the miner then, by hand, guides the drill steel from the formed bore. In prior art designs, before snap-on couplings and hoop springs, the drill steel was expected to fall downwardly under the influence of gravity and the components thereof. The components are then to be assembled within the mine cavern for the next drilling operation. However, due to the rigorous environment of the drilling operation as well as due to the vagaries of overhead seam structure and the like, such removal of the drill steel assembly is not always effective. Often, off-axis drilling and bending of the components takes place and the various portions thereof will not readily slide from the bore. As is apparent, drill steel often is left wedged within the bores and mining accidents are encouraged with the manual attempts at removal of drill steel and drill head bits wedged deep within the hole.

Figure 2:
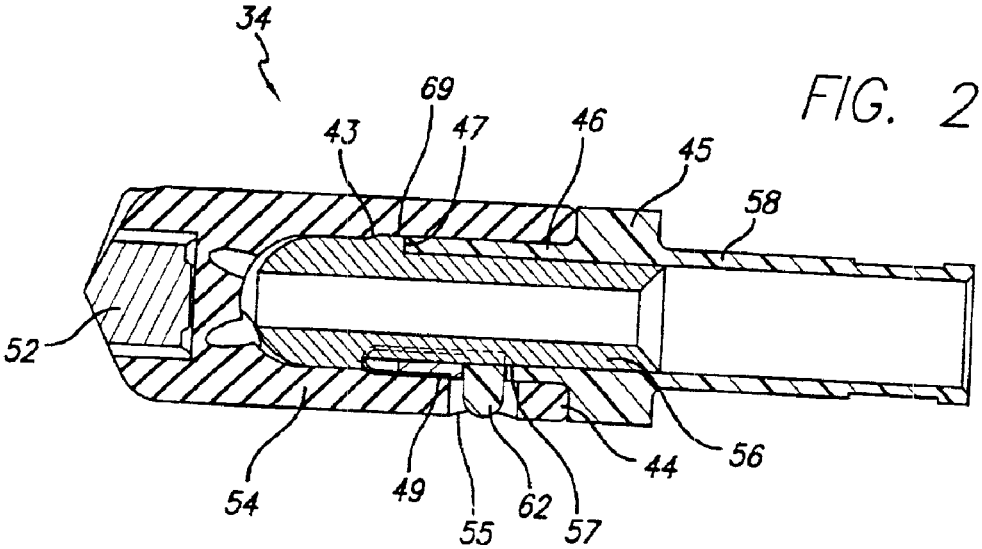
FIG. 2 is a cross sectional view of a drill head assembly.
Figure 3:
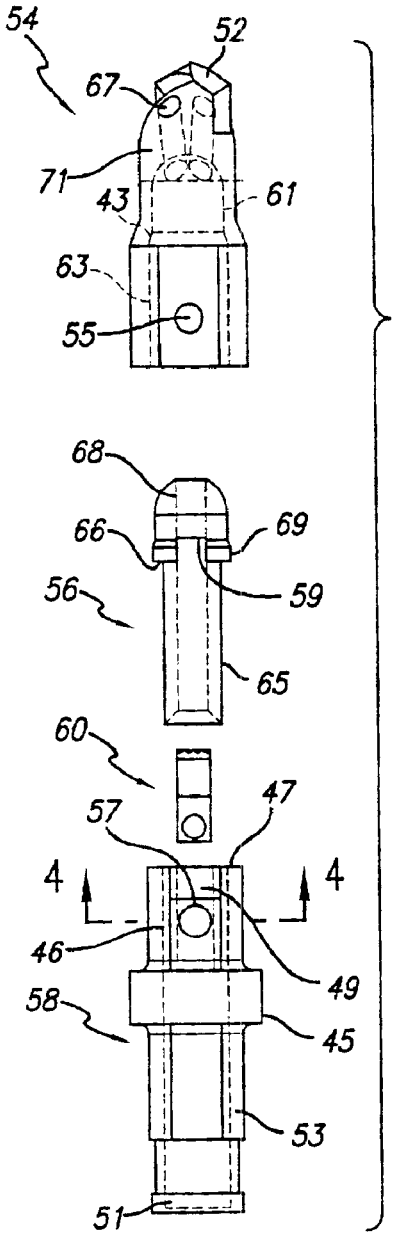
FIG. 3 is and exploded view of the drill head assembly illustrated in FIG. 2.
Figure 4:
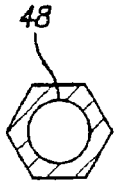
FIG. 4 is a cross-sectional view taken along lines 4—4 in FIG. 3.

Some drill head body and drill steel middle sections currently are connected together by hoop spring clips and snap buttons to reduce loss of drill steel in bores on account of wedging within bores. FIG. 2 illustrates an adaptor 58 having a cylindrical bore 48 (FIG. 4), the adaptor has a central section 45 that has an exterior hexagonal size and shape that is identical to the exterior size and shape of the drill steel 26. The adaptor has an upper male section 46 that has a hexagonal exterior surface as best seen in FIG. 4 that matches and tightly fits into the drill head body 54. A lower section 53 of the adaptor tightly fits into a hexagonal bore of hexagonal drill steel 32. The adaptor is connected to the drill steel by a hoop spring 51 as is well known and conventional in the art. A bushing seal 56 fits into the upper male section. In the embodiment illustrated the lower section 53 is hexagonal. Such a hexagonal design is required whenever the drill steel 36 is constructed of a plurality of components, as in U.S. Pat. Nos. 4,226,290 and 4,632,195.

The drill head body 54 is connected to the adaptor by a spring clip 60 having a button 62. The button 62 is received in a circular opening 55 in the drill head body 54. The adaptor 58 has a groove 49 for attaching the spring clip thereto during assembly. The tail 64 of the spring clip is hooked over the downstream end 47 of the adaptor and positioned to be received in the groove 49, the button is pushed onto the adaptor 58 until the button 62 is received in opening 57. Next bushing seal 56 has a notch 59 that is first aligned with the spring clip 60 and is next pushed into the adaptor bore until the bottom wall 66 of nipple 68 abuts against the end wall 47 of the adaptor. After the bushing seal 56 has been inserted onto the adaptor the subassembly of the bushing seal 56, spring clip 60 and adaptor 58 are inserted into drill head 54. The subassembly is first aligned so that the button is radially positioned to be in axial alignment with the opening 55 in the drill head. As the subassembly is pushed forward into the drill head the bushing seal and a forward end of the adaptor are positioned within the drill head body until the button 62 abuts up against the upstream end 44 of the drill head. The button can then be manually depressed inward so that the subassembly (56, 58, 60) can be advanced further inward into a receiving chamber of the drill head body 54. The subassembly (56, 58, 60) is then advanced inward into the drill head until button 62 snaps into opening 55 in the drill had body and drill head upstream end 44 simultaneously contact collar 45.

As best seen in FIG. 2 the drill head body 54 inner chamber has a stepped bore forming an annular surface 43. The upstream portion 63 of the stepped bore has a larger hexagonal cross section and the smaller downstream portion 61 of the stepped bore is cylindrical. The downstream cylindrical portion 61 of the chamber transitions into a semispherical portion. The bushing seal has an intermediate collar 69 positioned between the nipple 68 and shank 65 of the bushing seal. The collar 69 is clamped between the annular surface 43 and upstream endwall 47 of the adaptor fixing the bushing seal in position.

Alternatively, the upstream end wall 44 of the drill head and button 62 can be contoured to form cooperating cam surfaces so that as the adaptor subassembly (56, 58, 60) is pushed inward the button 62 is radially displaced toward the center of the bushing seal 56 bore so the button may slide past the upstream end wall into the drill head assembly until it snaps into opening 55. Such cooperating snap buttons are well known to ordinary artisans.

The spring clip can be made from many different types of spring steels, in one exemplary embodiment the spring steel is 0.018×0.255 SPRING STEEL, heat treat 44–50 RW "C". The bushing seal is constructed from a flexible material that has good sealing characteristics in pressures at up to 300 psi such as 60 Durometer EPDM.

Figure 5:
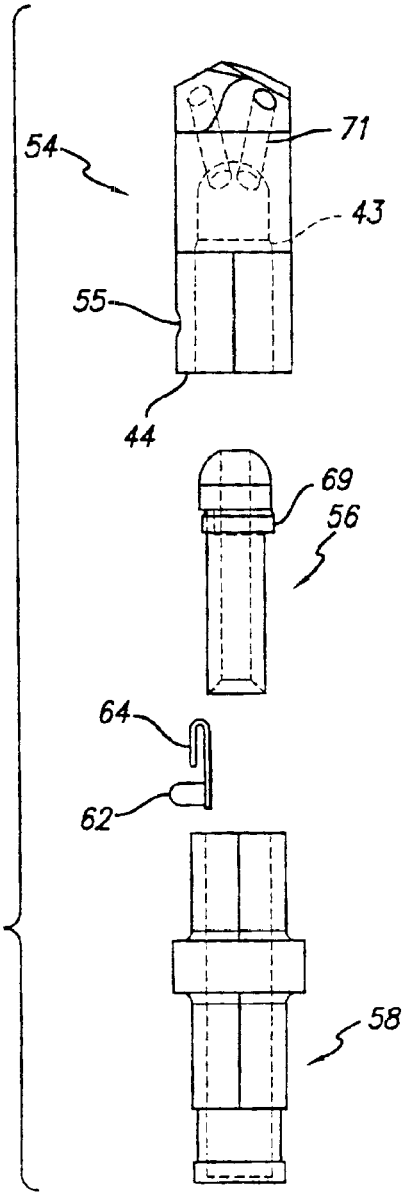
FIG. 5 is another exploded view of the drill head assembly illustrated in FIG. 2 taken from a line of sight rotated 90 degrees with respect to the longitudinal axis of the drill head illustrated in FIG. 3.

The drill head assembly in FIG. 2 has a lower section 53 of the adaptor that is insertable into a hollow drill steel 32, which is connected to a conventional drive mechanism (not shown) that rotates the drill steel. A rotary roof bit 30 depicted in FIGS. 4–5 comprises a cutting insert 52 mounted in a bit body 54. The insert can be held in a recess in the bit body by any suitable means, such as brazing, friction fit, etc. Flushing fluid such as water is conducted through outlets 67 in the bit body cools and flushes the insert 52 in the user manner.

Water is communicated from inside the drill steel 52 to the outlets 67 through passages 71 (shown in phantom). Although two passages 71 are illustrated in the specific embodiment, it should be understood that applicants do not intend to limit the scope of the invention to include two passages. Applicants contemplate that depending upon the particular application there may not be a need for any generally axially oriented passage or that there may be any number of such passages in the bit body. In a wet drilling operation, the passages would function to provide a pathway for a flow of fluid (e.g., water) to the forward end of the bit body, i.e., fluid would flow through the passages 71. Applicants also contemplate that for a wet drilling operation, the outside surface of the bit body may contain flats, or some other relief in the surface, so as to provide a passage for the fluid and debris to exit from near the cutting inserts.

The primary object of the present drilling methods is to deliver high volumes of water to the roof bit inserts to flush away debris and to cool the inserts, particularly at the heat generating cutting edges. Therefore, in the present invention the water pressure has a pressure in the range of 50 to 300 psi.

The bushing seal 56 prevents undesirable water pressure losses that otherwise might occur due to water leaks between the snap button 62 and corresponding opening 57 in the adaptor. The bushing seal additionally limits water leaking between the downstream end of the adaptor and drill head body.

In operation, with the drill bit head assembly 34 shown in FIG. 2 is snapped into onto the drill steel 32 of a dual boom roof bolter (not shown) or the like. The bolter (and other comparable machines) may be provided with a variable adjustment for rotational speed, so this feature of the method may be preselected and set into the machine in advance at the optimum or desired rotation within the moderate range of rpm. When the bore is established, the operator then increases the thrust on the bit up to the maximum preset machine thrust potential. At this time the operator also applies full water pressure for delivery to the bit inserts at dynamic pressures in the range of 50 psi to 300 psi. The supply of water adjacent to the drill bit head during drilling operations increases the rate of drilling, cools the drill head and assists in suppressing dust. The bushing seal reduces leaks and undesirable pressure losses at the drill head tip that otherwise reduce the efficiency and drilling rate of the roof bit.

It is now apparent that the objects and advantages of the present invention over the prior art have been fully met. Changes and modifications to the disclosed forms of the invention will become apparent to those skilled in the mining tool art.

What is claimed is:

1. A rotatable cutting bit head assembly comprising:

a) a drill head body having an axially forward end, an axially rearward end, a button opening and a stepped annular chamber, said button opening in communication with said stepped annular chamber, said stepped annular chamber having an upstream portion, an annular surface portion connected to said upstream portion and downstream portion connected to said annular surface portion;

b) an adaptor having an upper male section, a lower section, and an annular bore, said upper male section having a forward end wall, and a button opening in communication with said annular bore, said upper male section removably disposed within said drill head body annular chamber downstream portion, said adaptor button opening aligned with said drill head body button opening;

c) a flexible bushing seal comprising a nipple, a collar attached to said nipple, a shank attached to said collar, and an annular chamber, said collar having a notch said collar removably disposed between said drill head body stepped chamber annular surface portion and said adaptor forward end wall; and d) a spring clip having an integral button, said spring clip attached to said adaptor upper male section and removably disposed within said flexible bushing collar notch, and said button moveably disposed within said drill bit head button opening and said adaptor button opening;

wherein said bushing seal provides a fluid tight seal between said adaptor bore, said adaptor button opening, said drill head body chamber, said drill head body button opening and said integral button.

2. The rotatable cutting bit head assembly of claim 1 wherein said upper male section has a hexagonal cross-section and said stepped annular chamber upstream portion has a hexagonal cross-section.

3. A flexible bushing seal for use in providing a fluid tight seal between a drill head body and an adaptor attached to said drill head body by a button spring clip in a roof drilling assembly, said flexible bushing seal comprising:

a nipple;

a collar attached to said nipple, said collar having a lateral notch for receipt of said button spring clip;

a shank attached to said collar; and an annular chamber.

4. A drill steel assembly for a drilling machine, said drilling machine having a drill head with a chuck for receiving said drill steel assembly, said drill steel assembly comprising:

a driver steel component;

a finisher drill steel, wherein said finisher drill steel is attached to said driver steel component; and a rotatable cutting bit head assembly attached to said finisher drill steel, said rotatable cutting bit head assembly comprising:

a) a drill head body having an axially forward end, an axially rearward end, a button opening and a stepped annular chamber, said button opening in communication with said stepped annular chamber, said stepped annular chamber having an upstream portion, an annular surface portion connected to said upstream portion and a downstream portion connected to said annular surface portion;

b) an adaptor having an upper male section, a lower section, and an annular bore, said upper male section having a forward end wall, and a button opening in communication with said annular bore, said upper male section removably disposed within said drill head body annular chamber downstream portion, said adaptor button opening aligned with said drill head body button opening;

c) a flexible bushing seal comprising a nipple, a collar attached to said nipple, a shank attached to said collar, and an annular chamber, said collar having a notch, said collar removably disposed between said drill head body stepped chamber annular surface portion and said adaptor forward end wall; and d) a spring clip having an integral button, said spring clip attached to said adaptor upper male section and removably disposed within said flexible bushing collar notch, and said button moveably disposed within said drill bit head button opening and said adaptor button opening;

wherein said bushing seal provides a fluid tight seal between said adaptor bore, said adaptor button opening, said drill head body chamber, said drill head body button opening and said integral button.

* * * * *

UNITED STATES PATENT AND TRADEMARK OFFICE

CERTIFICATE OF CORRECTION

PATENT NO. : 6,886,645 B2
DATED : May 3, 2005
INVENTOR(S) : Douglas E. Bise and Phillip W. Haga It is certified that error appears in the above-identified patent and that said Letters Patent is hereby corrected as shown below:

Column 6,
Line 19, delete “downstream” and replace with -- upstream --.

Column 7,
Line 8, delete “downstream” and replace with -- upstream --.

Signed and Sealed this

Thirtieth Day of May, 2006

JON W. DUDAS
*Director of the United States Patent and Trademark Office*